United States Patent [19]

Houghton

[11] Patent Number: 5,035,342

[45] Date of Patent: Jul. 30, 1991

[54] CONTAINER FOR NUCLEAR FUEL ELEMENTS

[75] Inventor: Anthony T. Houghton, Warrington, United Kingdom

[73] Assignee: British Nuclear Fuels plc, Warrington, United Kingdom

[21] Appl. No.: 536,271

[22] Filed: Jun. 11, 1990

[30] Foreign Application Priority Data

Jul. 8, 1989 [GB] United Kingdom ..... 8915700

[51] Int. Cl.[5] ..... B65D 1/24

[52] U.S. Cl. ..... 220/23.2; 220/528; 376/272; 250/506.1; 250/507.1

[58] Field of Search ..... 220/528, 23.2, 23.83; 206/443, 524.1; 376/272; 250/506.1, 507.1, 518.1

[56] References Cited

U.S. PATENT DOCUMENTS

| | | | |
|---|---|---|---|
| 4,042,828 | 8/1977 | Rubinstein | 250/506.1 X |
| 4,088,897 | 5/1978 | Soot | 376/272 |
| 4,139,778 | 2/1979 | Raymond | 376/272 |
| 4,277,680 | 7/1981 | Rodriguez et al. | 376/272 |
| 4,288,699 | 9/1981 | van der Vlis et al. | 376/272 |
| 4,636,351 | 1/1987 | Rohr | 250/507.1 X |
| 4,815,624 | 3/1989 | Houghton | 376/272 X |
| 4,930,650 | 6/1990 | Wells | 376/272 X |

*Primary Examiner*—Steven M. Pollard
*Attorney, Agent, or Firm*—William R. Hinds

[57] ABSTRACT

A transport and storage container for nuclear fuel elements comprises a vessel with a removable internal structure. The internal structure defines a plurality of elongate compartments to receive fuel elements and the walls of the compartments are formed by inter-engageable elongate rectangular plates disposed at right angles to one another. Spider assemblies arranged at intervals along the length of the structure hold the plates together.

4 Claims, 4 Drawing Sheets

CONTAINER FOR NUCLEAR FUEL ELEMENTS

The present invention concerns a container for nuclear fuel elements, in particular fuel elements from a pressurized water reactor. Such a container is known as a multi-element bottle and is removably located within a flask for the transport and storage of the fuel elements.

According to the present invention a container for the transport and storage of nuclear fuel elements comprises a vessel having a removable internal structure, the internal structure defining a plurality of substantially identical elongate compartments disposed in a circular array and the walls of which are formed by inter-engageable elongate rectangular plates disposed substantially at right angles to one another with spider assemblies located at intervals along the length of the array, each spider assembly including an inner plate having side edges cooperable with the inner walls of the compartments and having arms passing through the walls to carry outer plates engageable with radially extending side walls of the compartments.

Preferably a central compartment is located and supported in a central aperture in the inner plate.

The longitudinal side edges of the plates can be provided with cooperating tongues and notches.

An adjustable tensioning band can encircle each spider assembly. Combs or spacer bars can be provided for positioning the spider assemblies at regular intervals along the length of the internal structure.

The invention will be described further, by way of example, with reference to the accompanying drawings, in which.

FIGS. 5*a* to 5*e* show different wall panels used in the assembled container.

Figure 2:
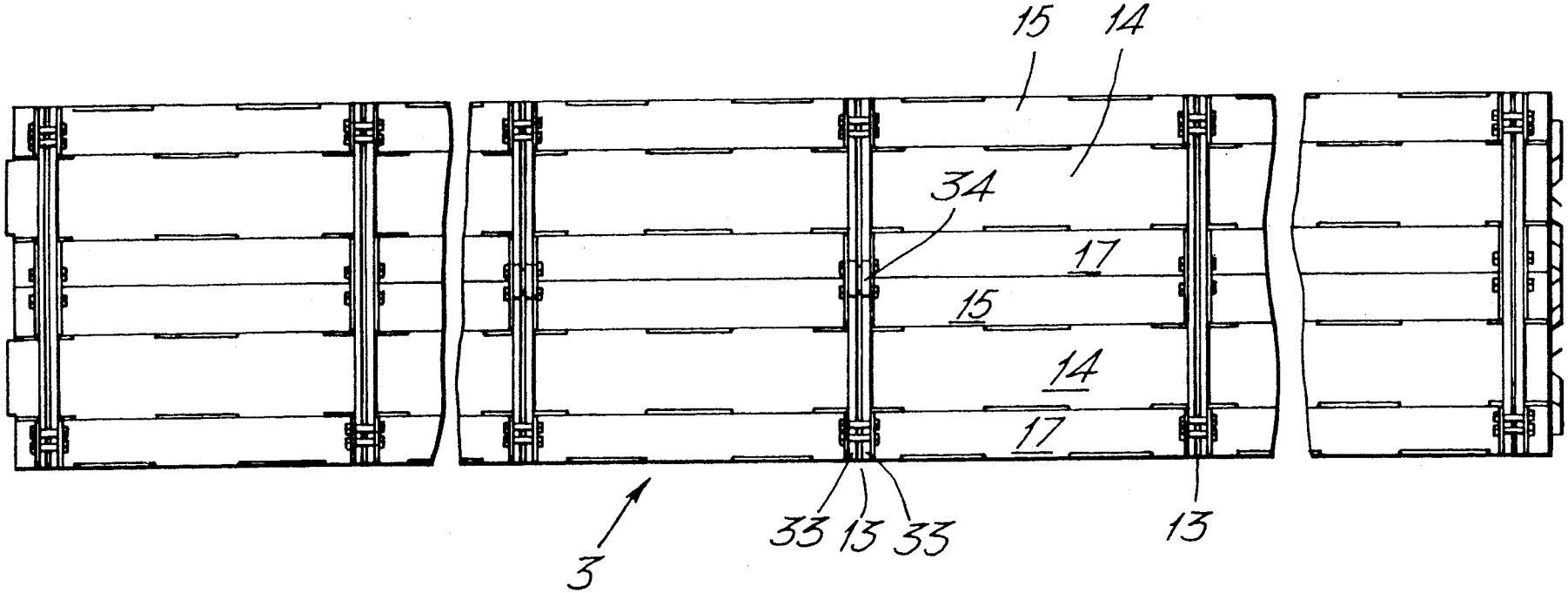
FIG. 2 is a fragmentary side view of a removable internal structure of the container.

A container 1 comprises a cylindrical vessel 2 having a removable internal structure 3. The internal structure 3 includes a plurality of elongate compartments 12 to receive irradiated nuclear fuel elements, in particular fuel elements from a pressurized water reactor. In the present arrangement, which is given as an example, ah assembly of six compartments are pitched on a circle about a central compartment. The structure is not limited to six compartments. Each compartment is rectangular in section and the compartments are secured in position by spider assemblies 13 arranged at regular intervals along the length of the assembly and as shown in FIG. 2.

The walls of the compartments are formed from panels or plates shown in FIGS. 5*a* to 5*e*. The panels are notched or rebated along each longitudinal side edge in such a manner that upstanding tongues in one panel can engage in notches formed between upstanding tongues in another panel.

Figure 1:
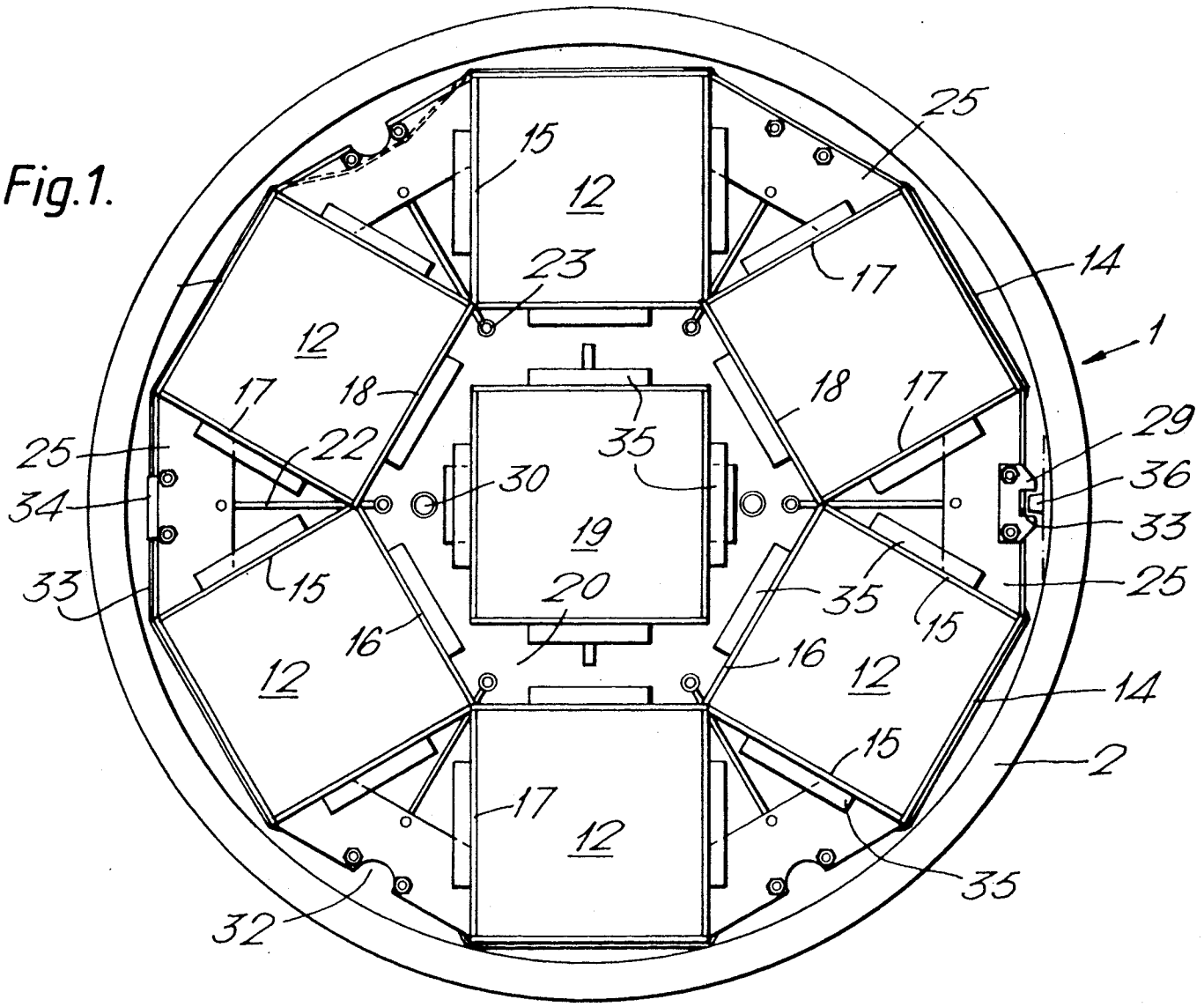
FIG. 1 is an end view of an assembled container for irradiated nuclear fuel elements.

With reference to FIG. 1 it is seen that the outer walls of the six encircling compartments are identical. These walls are formed by panels 14 of the kind shown in FIG. 5*a* of the drawings. It will be noted from FIG. 1 that the inner corners of adjacent compartments interengage and overlap. To achieve this result the panels forming the remaining walls of alternate adjacent compartments are different in configuration with the compartments falling into two different sets, each set in the present example being of three compartments. The sets are staggered with the compartments of one set being located between the compartments of the other set.

The walls of the compartments of the first set are formed by panels 14, 15 and 16. Likewise the walls of the compartments of the second set are formed by panels 14, 17 and 18. These panels are shown in FIGS. 5*a*, 5*b*, 5*c*, 5*d* and 5*e*.

For the first set the tongues and notches in the side edges of the outer panel 14 cooperate and interengage a respective side edge of the two radial panels 15. The other side edge of each panel 15 and the two side edges of the remaining panel 16 which cooperate therewith have longer notches which permit intermeshing and overlapping at the corners of adjacent compartments. Likewise, for the second set, the tongues and notches in the side edges of the panels 14 and 17 cooperate and interengage. The other side edges of the panels 17 and the cooperating panel 18 are again formed to permit the intermeshing and overlapping at the inner corners of adjacent compartment 12. The effect of the overlapping at the corners of the compartments is to reduce the overall diameter of the internal structure 3 and hence of the container 1.

The central compartment 19 can also be formed from wall panels having complementary tongues and notches. Apertures are provided in the panels of all compartments to permit circulation of water when the internal structure 3 is in position within the vessel 2. Also, some of the wall panels can be slightly longer than the remaining panels to allow water circulation at the bottom of the internal structure and to serve as feet. In the present example, the panels 14 are slightly longer than the remaining panels.

Figure 3:
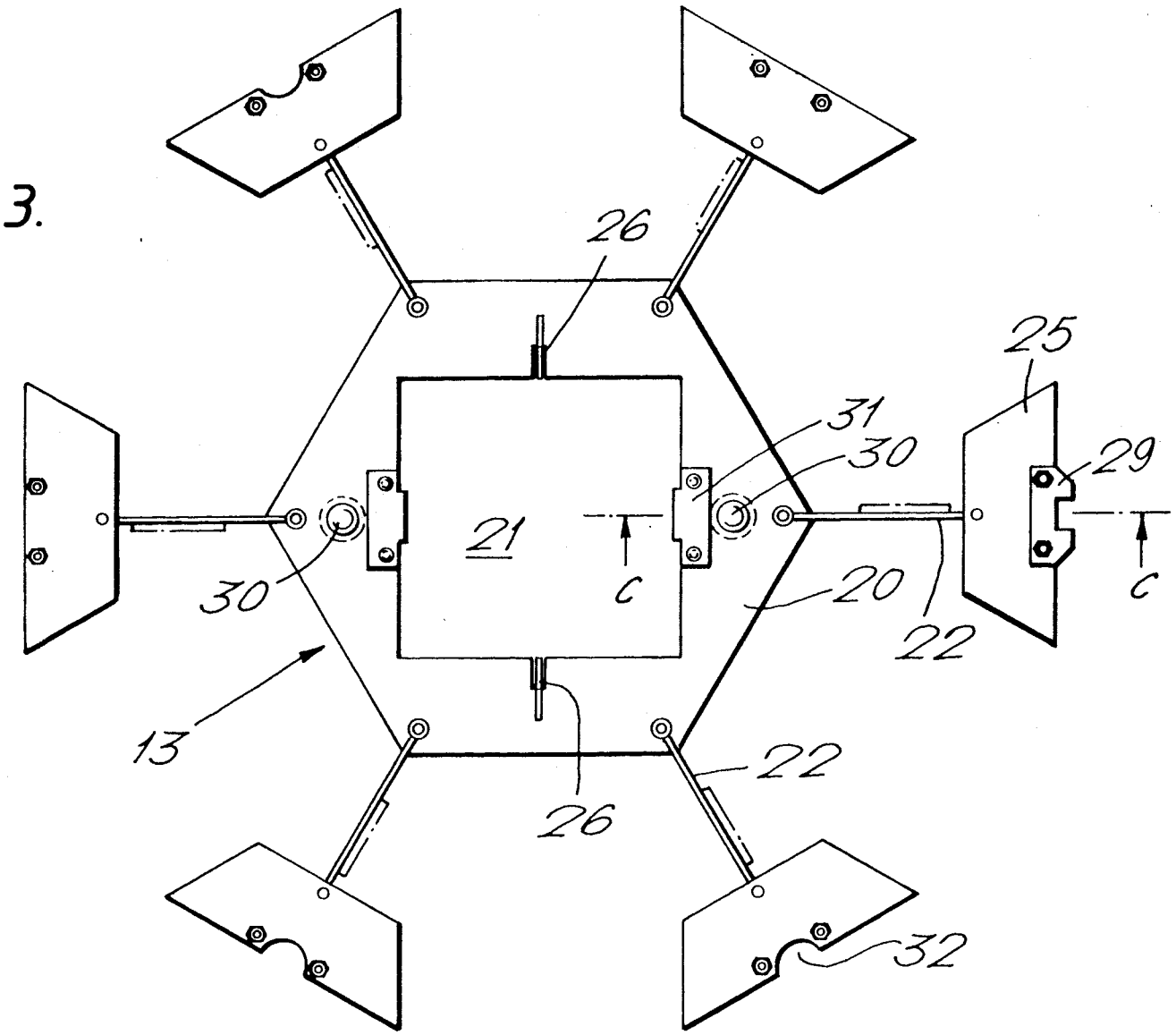
FIG. 3 shows a spider assembly.
Figure 4:
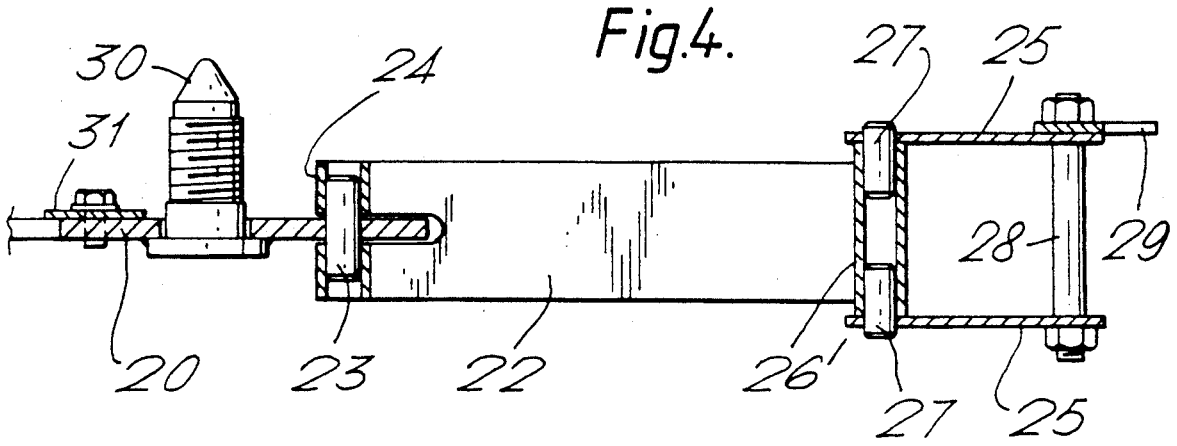
FIG. 4 is a section on C—C in FIG. 3.
Figure 5A:
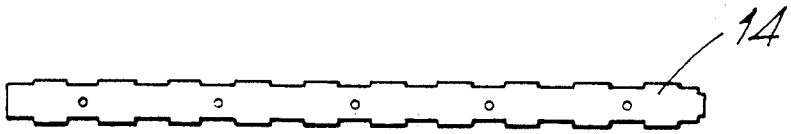
Figure 5B:
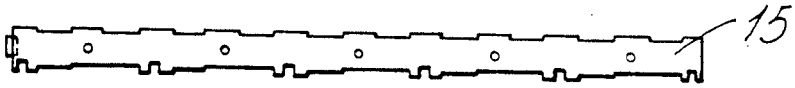
Figure 5C:
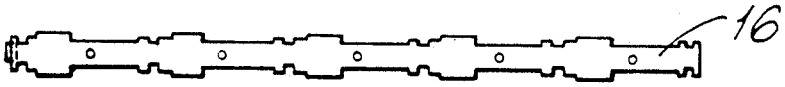
Figure 5D:
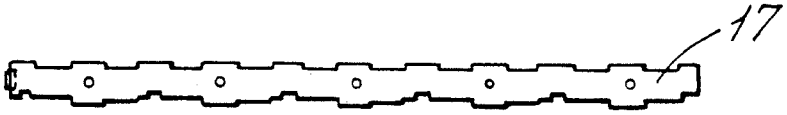
Figure 5E:
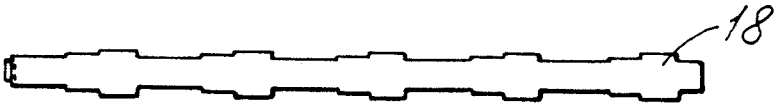

With reference to FIGS. 3 and 4, each spider assembly 13 comprises a central hexagonal plate 20 having a rectangular aperture or opening 21 to receive the central compartment 19. A spider arm 22 is secured to each corner of the hexagonal plate. Oxygen getters, shown in phantom, can be mounted on each arm 22. The plate 20 engages in a slot in the spider arm 22 and the arm is secured by a pin 23 which is housed in a collar 24 secured to the end of the spider arm 22, the pin engaging and passing through an aperture in the hexagonal plate 20. At its outer end the spider arm supports a pair of spider plates 25, each plate being shaped as a trapezium. The end of the spider arm is fixedly secured as by welding to a collar $26^1$ and the two spider plates 25 are fastened to the collar $26^1$ by means of pins 27. The spider plates are further supported by a pair of pins or spacers 28 and a key plate 29 can be anchored to one or more upper spider plate by means of the spacers 28. Lifting bosses 30 are welded to the hexagonal plate 20 and a pair of adjustable locking plates 31 are provided on the hexagonal plate 20 to engage the central compartment 19. The spider assemblies 13 are positioned at regular intervals along the length of the internal structure 3 by being mounted on combs 26. The combs 26 are elongate bars having slots at regular spaced intervals to cooperate with the plates 20. The combs 26 are maintained in position and in engagement with the plates 20 by the walls of the central compartment 19. The panels forming the compartments 12 have notches to allow the spider arms 22 to pass through the panels at the overlapping corners of the compartments.

The internal structure 3 is removably and slidably housed in vessel 2 and the key plate 29 cooperates with a key 36 on the interior of the vessel 2. Some of the spider plates 25 are notched as indicated at 32 in order to accommodate ullage tubes and the like within the vessel.

A pair of banding straps 33 encircle each spider assembly and are tightened by buckles 34 to hold the assembled container together.

Guides 35 for guiding fuel elements into the compartments 12 can be provided at the ends of the wall panels.

I claim:

1. A container for the transport and storage of nuclear fuel elements comprising a vessel having a removable internal structure, the internal structure defining a plurality of substantially identical elongate compartments disposed in a circular array and the walls of which are formed by inter-engageable elongate rectangular plates disposed substantially at right angles to one another with spider assemblies located at intervals along the length of the array, each spider assembly including an inner plate having side edges cooperable with the inner walls of the compartments and having arms passing through the walls to carry outer plates engageable with radially extending side walls of the compartments.

2. A container according to claim 1 including an aperture in the inner plate of each spider assembly and a central compartment supported in the apertures.

3. A container according to claim 1 including cooperating tongues and notches in the longitudinal side edges of the elongate rectangular plates.

4. A container according to claim 3 including combs for positioning the spider assemblies at regular intervals along the length of the internal structure.

* * * * *